US006644217B1

(12) United States Patent
Meyer et al.

(10) Patent No.: US 6,644,217 B1
(45) Date of Patent: Nov. 11, 2003

(54) PALLET SYSTEM AND METHOD

(76) Inventors: Lyle Meyer, 1137 N. Elm St., West Liberty, IA (US) 52776; Gerald Edson, 1537 W. Harlan Dr., Terre Haute, IN (US) 47802

( * ) Notice: Subject to any disclaimer, the term of this patent is extended or adjusted under 35 U.S.C. 154(b) by 0 days.

(21) Appl. No.: 10/163,907

(22) Filed: Jun. 6, 2002

(51) Int. Cl.[7] ..... B65D 19/44
(52) U.S. Cl. ..... 108/55.3; 108/51.11
(58) Field of Search ..... 108/51.11, 55.13, 108/55.1, 57.25, 57.28, 57.29

(56) References Cited

U.S. PATENT DOCUMENTS 2,738,058 A * 3/1956 Hansen et al. ..... 108/55.1
3,628,468 A * 12/1971 Angelbeck, Jr. ..... 108/53.1
3,747,780 A * 7/1973 Schneider ..... 108/55.3
4,543,035 A * 9/1985 Lair ..... 108/55.1
4,848,247 A * 7/1989 Kuipers ..... 108/53.1
5,685,233 A * 11/1997 DeJean ..... 108/56.1
6,112,672 A * 9/2000 Heil ..... 108/55.3
6,305,301 B1 * 10/2001 Piper et al. ..... 108/57.25
6,382,108 B1 * 5/2002 Stanek et al. ..... 108/55.1

FOREIGN PATENT DOCUMENTS

FR 2661656 * 11/1991

* cited by examiner

*Primary Examiner*—Jose V. Chen
(74) *Attorney, Agent, or Firm*—Daniel J. O'Connor

(57) ABSTRACT

A pallet which is specially designed for use in combination with a particular manufacturing process. The pallet includes air ventilation apertures which allow an upper product-containing bag to breathe. Specially designed upper channels allow further ventilation and bag pick-up or deposit when desired during a manufacturing process. The underside of the pallet includes reinforced areas and multiple entry ports for use with a fork-lift truck.

1 Claim, 2 Drawing Sheets

PALLET SYSTEM AND METHOD

BACKGROUND AND OBJECTS OF THE INVENTION

The present invention is generally related to the support and transport arts and, in particular, to a novel design for pallet construction and use.

The system disclosed is designed for use in combination with large porous or burlap-type bags which contain, for example, nuts.

Prior arts pallet designs have proven to be costly to manufacture and difficult to use in large scale manufacturing operations.

Accordingly, it is an object of the present invention to set forth a novel pallet design which may be economically manufactured using, in part, recycled rubber and plastic materials.

It is a further object of the invention to demonstrate a pallet design having increased strength characteristics for improved performance in a heavy duty manufacturing environment.

It is also an object of the invention to show a pallet system which includes unique air flow and air circulation features for use in a specialized manufacturing operation.

It is a still further object of the invention to set forth a pallet which is highly fire resistant for use in high temperature manufacturing processes.

It is also an object of the invention to show a pallet structure having loading and unloading structural features so that a single operator can perform most of the necessary functions required.

These and other objects and advantages of the invention will be apparent to those of skill in the art from the description which follows.

PRIOR ART PATENTS AND DESIGNS

U.S. Pat. No. 6,357,366 issued to Frankenberg in 2002 teaches the use a a rackable molded pallet with improved structural integrity. The design includes foot straps with releasable fasteners.

U.S. Pat. No. 6,352,039 issued to Woods et al. in 2002 teaches the use of a plastic pallet with good load bearing construction. The design includes solid deck boards and ridges.

In contrast to the above designs, the present invention includes upper located air flow apertures and upper channels for advantageous use in combination with a particular manufacturing process, i.e. treating a product contained within a bag.

The present invention is thus believed to be clearly patentable over all known prior art pallet designs.

SUMMARY OF THE INVENTION

A pallet is used in combination with a large bag which is porous and may be fabricated, for example, of burlap material. The bag may contain various materials to be treated in a manufacturing process involving multiple steps.

The pallet structure has elongated channels formed on the top thereof to allow fork-lift entry from an upper location and to permit air flow as a part of the treatment process.

The pallet top area also includes apertures to allow air circulation through the pallet.

The underside of the pallet includes special reinforcing areas where needed for strength and long-life of the overall unit.

The pallet underside further includes multiple fork-lift entry ports for use when it is desired to move both the bag and pallet combination.

BRIEF DESCRIPTION OF THE DRAWING FIGURES

FULL DESCRIPTION OF A PREFERRED EMBODIMENT

Figure 1:
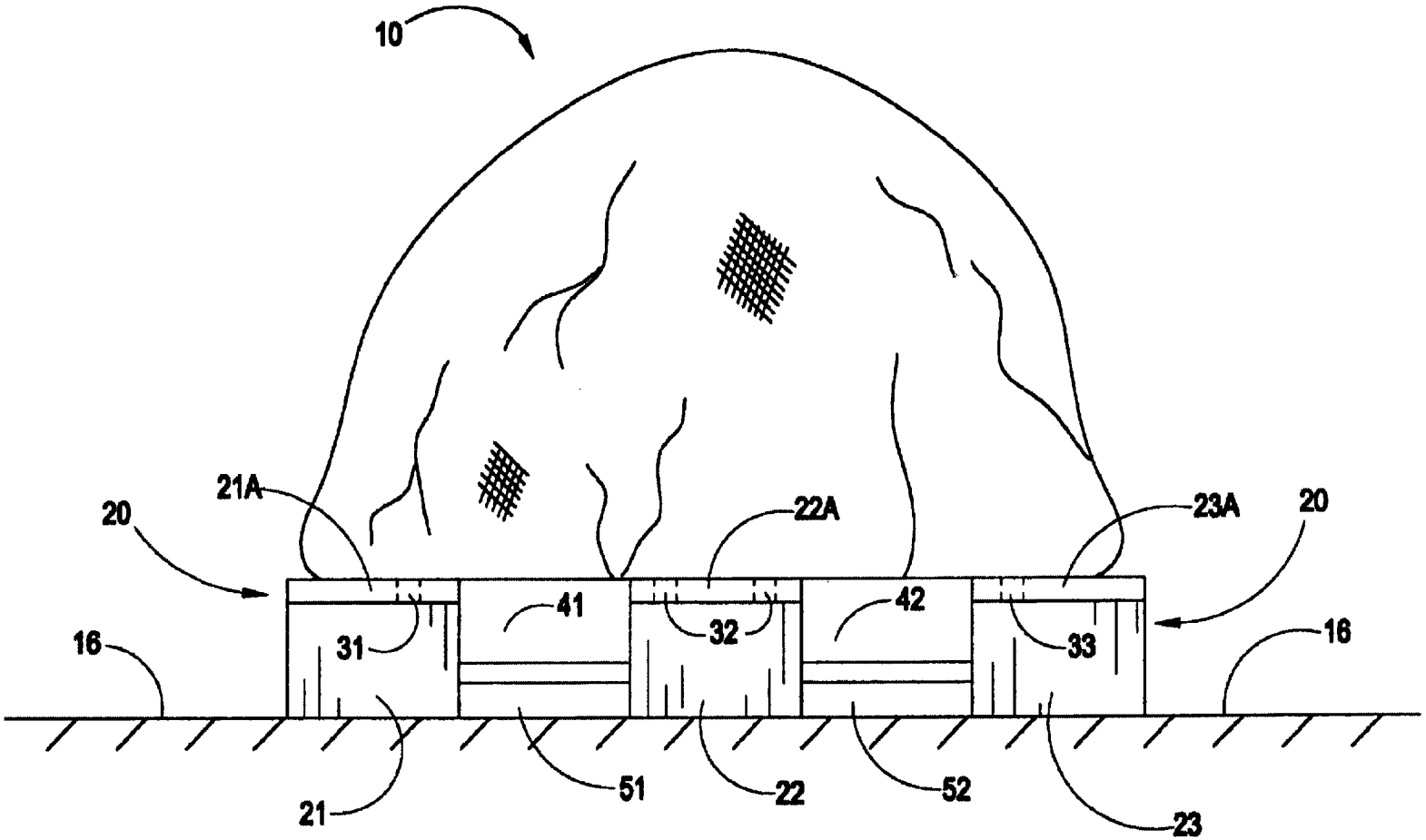
FIG. 1 is a side schematic view of the bag and pallet combination. The upper pallet channel areas are shown as well as some of the air flow apertures and lower extending support elements.

Referring to the drawing figures, the side schematic view of FIG. 1 shows a large bag 10 positioned on top of a support or pallet 20.

The bag 10 may be of a porous or burlap type and contains a product 12 to be treated during various manufacturing steps. The product 12 may comprise, for example, nuts.

FIG. 1 shows three of the lower extending pallet elements 21, 22 and 23. As to be further described, the pallet 20 would typically include nine of such lower extending supports and such supports would be of a generally rectangular or square configuration.

The supports 21, 22 and 23 include top areas 21*a*, 22*a* and 23*a*. These top areas have apertures 31, 32 and 33 formed therein for the purpose of circulating air flow to the porous bag 10 and product 12 being treated, i.e. allowing the bag to breathe.

FIG. 1 shows the bag and pallet combination resting on a floor area 16.

The pallet 20 further includes channels 41 and 42 formed therein. These channels 41 and 42 serve at least two important purposes. First, the channel depth permits air flow to the underside of the porous bag 10. Second, the channel depth allows sufficient space for fork-lift elements to be placed under the bag 10 for removal from the pallet when desired.

Such feature permits a single operator to perform the various movement steps required in the manufacturing process. Thus, labor time and costs are reduced and the product may be treated and produced at a more economical rate.

In a further important economical aspect of the invention, the entire pallet 20 may be compression molded from recycled plastic and rubber materials. Such materials usage and compression molding results in a greatly reduced pallet cost.

FIG. 1 further shows two of the lower fork-lift entry ports 51 and 52. As will be further shown and described, a typical pallet 20 would include a total of eight lower fork-lift entry ports so that the pallet can be lifted and moved from various desired directions.

Figure 2:
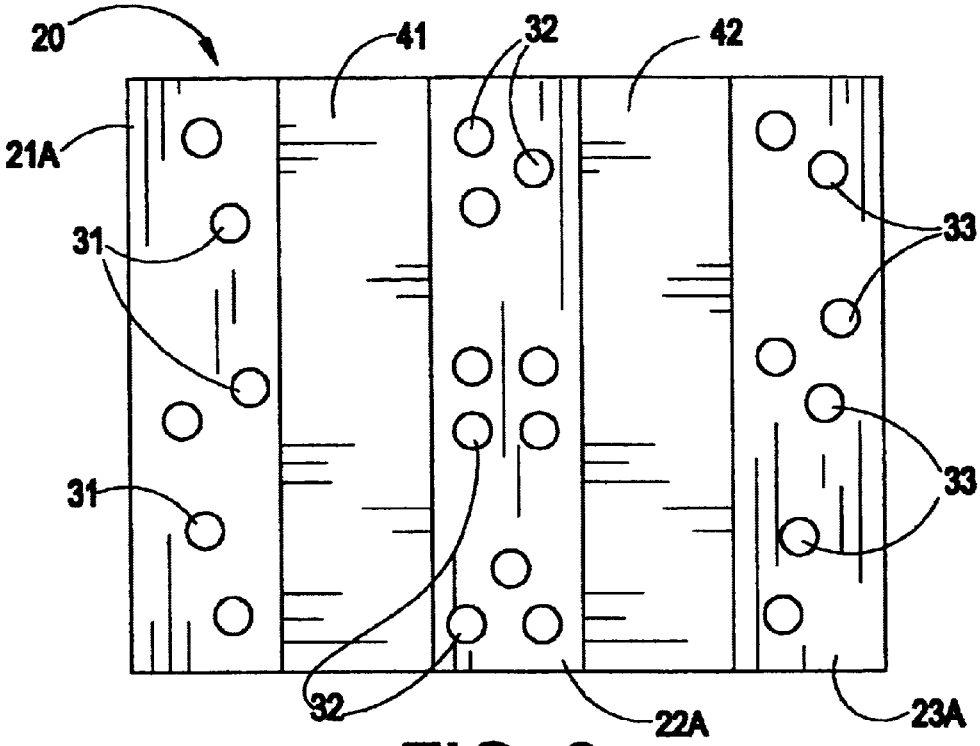
FIG. 2 is a top view of the pallet structure with the bag removed and shows the upper channel shape and position as well as the possible locations of the air circulation apertures.

FIG. 2 shows a top view of the pallet 20. Channels 41 and 42 are shown as extending the length of the pallet. As indicated, the channels 41 and 42 are positioned between the top raised elements 21*a*, 22*a* and 23*a*.

The plural air flow apertures 31, 32 and 33 are also indicated in the top view of FIG. 2.

In practice of the invention, the air flow apertures are slightly more densely grouped toward the center of the pallet 20 in areas where more breathing air flow is advantageous for an upper product-containing porous bag.

The air flow apertures 31, 32 and 33 are on the order of two inches in diameter.

Figure 3:
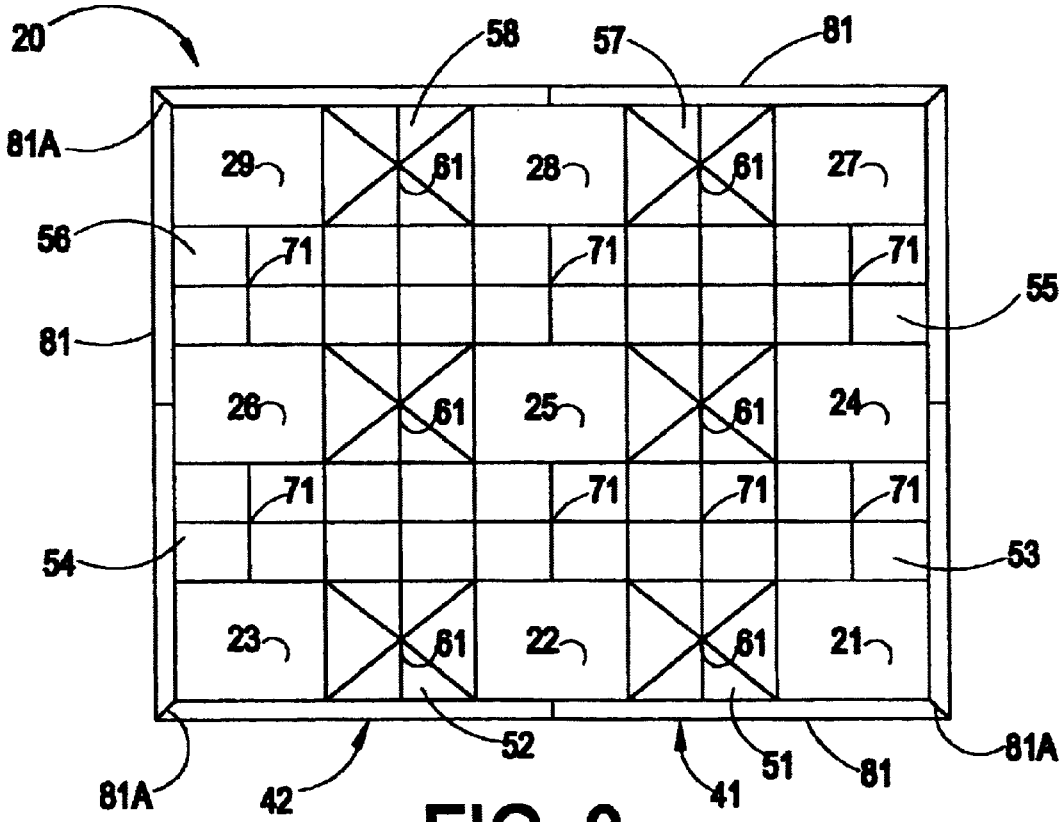
FIG. 3 is a view of the underside of the pallet. Various reinforcing areas are shown as well as the multiple entry ports for use in combination with a fork-lift truck.

FIG. 3 hows the underside view of pallet 20. In this view, upper channels 41 and 42 are hidden from view.

FIG. 3 shows the nine extending supports 21–29. FIG. 3 also shows the multiple fork-lift entry ports at numerals 51 to 58.

Numerals 61 indicate X-shaped reinforcing ridges which are provided to give added support to the channels 41 and 42 in operational use of the pallet. Numerals 71 show cross-shaped reinforcing ridges which are located on the remainder of the pallet underside. Ridges 61 and 71 act as strengthening braces for the overall pallet and provide the necessary long-life and bending resistance needed in high volume manufacturing operations. Outer ridges 81 and 81*a* provide additional strength at the periphery of the pallet unit 20.

While a particular design and system has been shown and described, it is intended in this specification to broadly cover all equivalent structures which would reasonably occur to those of skill in the art.

We claim:

1. A pallet system (20 for use in high-volume transport and manufacturing operations and in combination with a porous bag element (10) containing a particular product (12), said pallet (20) including a plurality of lower extending support elements (21–29), said pallet (20) including top wall elements (21*a*, 22*a*, 23*a*) extending the length of said pallet, wherein said top wall elements include plural air flow aperture means (31, 32, 33) for providing a breathing air flow to and from a porous bag (10) positioned on top of said pallet, the top portion of said pallet further including channel means (41, 42) extending the length of said pallet to provide air flow to and from said bag and to allow sufficient space that a fork-lift device may be utilized to remove the bag (10) from the pallet (20) when desired, said pallet (20) further including a plurality of fork-lift ports (51–58) at the sides thereof, wherein said pallet is fabricated of recycled rubber and plastic materials and is made by using a compression molding process, said pallet further including nine lower support elements (21–29), wherein an underside of said pallet includes ten cross-shaped reinforcing areas (71) which extend transversely of said channel means (41, 42), said cross-shaped reinforcing areas (71) being formed directly on the underside of said pallet, wherein the underside of said pallet further includes six X-shaped reinforcing areas (61) which are located directly under said channel means (41, 42) to provide extra strengthening support for said channel means, said channel means (41, 42) each being formed as a solid channel open only at the ends thereof and being positioned between said top wall elements (21*a*, 22*a*, 23*a*), wherein said bag element (10) and said product (12) comprise a burlap bag substantially filled with nuts for treatment in a manufacturing process.

* * * * *